US008819946B2

(12) United States Patent
Yamasaki et al.

(10) Patent No.: US 8,819,946 B2
(45) Date of Patent: Sep. 2, 2014

(54) ELECTRIC SHAVER

(75) Inventors: Masanobu Yamasaki, Hikone (JP); Takeshi Shiba, Hikone (JP); Juzaemon Iwasaki, Nagahama (JP); Shinji Fujimoto, Neyagawa (JP); Masaaki Sato, Hikone (JP); Shunsuke Komori, Hikone (JP)

(73) Assignee: Panasonic Corporation, Osaka (JP)

( * ) Notice: Subject to any disclaimer, the term of this patent is extended or adjusted under 35 U.S.C. 154(b) by 407 days.

(21) Appl. No.: 12/088,052

(22) PCT Filed: Sep. 27, 2006

(86) PCT No.: PCT/JP2006/319127

§ 371 (c)(1),
(2), (4) Date: Mar. 25, 2008

(87) PCT Pub. No.: WO2007/037251

PCT Pub. Date: Apr. 5, 2007

(65) Prior Publication Data

US 2009/0241343 A1 Oct. 1, 2009

(30) Foreign Application Priority Data

Sep. 27, 2005 (JP) ..... P2005-280929

(51) Int. Cl.
*B26B 19/02* (2006.01)
*B26B 19/04* (2006.01)

(52) U.S. Cl.
CPC ..... *B26B 19/048* (2013.01)
USPC ..... 30/527; 30/32; 30/43; 30/57

(58) Field of Classification Search
USPC ..... 30/32, 43, 43.1, 43.3, 43.92, 57, 58, 30/526, 527, 529, 43.91, 42, 50, FOR. 102, 30/FOR. 104
See application file for complete search history.

(56) References Cited

U.S. PATENT DOCUMENTS

| | | | |
|---|---|---|---|
| 4,796,359 | A | 1/1989 | Oprach et al. |
| 5,564,191 | A | 10/1996 | Ozawa |
| 2004/0010919 | A1 | 1/2004 | Shiba et al. |
| 2004/0128834 | A1 | 7/2004 | Royle |
| 2004/0231160 | A1 | 11/2004 | Shiba et al. |

(Continued)

FOREIGN PATENT DOCUMENTS

| | | |
|---|---|---|
| EP | 0721824 | 7/1996 |
| EP | 1405701 | 4/2004 |

(Continued)

OTHER PUBLICATIONS

English language Abstract of JP 2005-192615, Jul. 21, 2005.

(Continued)

*Primary Examiner* — Phong Nguyen
(74) *Attorney, Agent, or Firm* — Greenblum & Bernstein, P.L.C.

(57) ABSTRACT

A support arm that is rockably supported on one end of a grip portion and projects from the one end is provided. Both ends of a blade head are supported by the support arm such that the blade head can rock around an axis extending along a reciprocating direction of an inner blade, and an axial direction of the rocking motion of the support arm with respect to the grip portion is set in a direction intersecting with the reciprocating direction of the inner blade. This configuration achieves an electric shaver capable of increasing the movable range of the blade head while preventing a main body from increasing in size.

14 Claims, 10 Drawing Sheets

(56) References Cited

U.S. PATENT DOCUMENTS

| | | | |
|---|---|---|---|
| 2004/0237310 | A1 | 12/2004 | Shiba et al. |
| 2005/0016002 | A1 | 1/2005 | Fukutani et al. |
| 2005/0138821 | A1 | 6/2005 | Tsushio et al. |
| 2006/0137187 | A1 | 6/2006 | Fukutani et al. |
| 2006/0150421 | A1 | 7/2006 | Sato et al. |
| 2007/0022607 | A1 | 2/2007 | Takeuchi et al. |
| 2007/0227007 | A1 | 10/2007 | Fukutani et al. |
| 2007/0245565 | A1 | 10/2007 | Sato et al. |

FOREIGN PATENT DOCUMENTS

| | | |
|---|---|---|
| EP | 1439040 | 7/2004 |
| GB | 2266070 | 10/1993 |
| JP | 62-227395 | 10/1987 |
| JP | 6-343776 | 12/1994 |
| JP | 10-43443 | 2/1998 |
| JP | 2001-29674 | 2/2001 |
| JP | 2003-93765 | 4/2003 |
| JP | 2003-210871 | 7/2003 |
| JP | 2004-16518 | 1/2004 |
| JP | 2005-192615 | 7/2005 |
| JP | 2005-237598 | 9/2005 |

OTHER PUBLICATIONS

English language Abstract of JP 6-343776, Dec. 20, 1994.
English language Abstract of JP 2004-16518, Jan. 22, 2004.
English language Abstract of JP 2001-29674, Feb. 6, 2001.
English language Abstract of JP 10-43443, Feb. 17, 1998.
English language Abstract of JP 2003-210871, Jul. 29, 2003.
English language Abstract of JP 2005-237598, Sep. 8, 2005.
English language Abstract of JP 2003-93765, Apr. 2, 2003.

(a)

(b)

ELECTRIC SHAVER

TECHNICAL FIELD

The present invention relates to an electric shaver having a blade head which is movably supported by a grip portion.

BACKGROUND ART

Conventionally, to enhance shaving performance and the like, there is known an electric shaver in which a blade head which comes into contact with skin is movably supported by a grip portion to enhance skin-following capability (for example, Japanese Patent Application Laid-open No. 2003-93765).

In the electric shaver disclosed in Japanese Patent Application Laid-open No. 2003-93765, a head block as a blade head including an outer blade and an inner blade that reciprocates and slides inside of the outer blade is rockably connected to one end of a main body block including a grip portion. Accordingly, the outer blade of the head block comes into contact with skin in an appropriate attitude, thereby enhancing skin-following capability and shaving performance.

The head block is biased by a spring in an abutting direction against the skin, thereby enhancing impact-absorption against ruggedness of bones.

According to the electric shaver disclosed in Japanese Patent Application Laid-open No. 2003-93765, however, rod-like head support members which respectively support both ends of the head block in its longitudinal direction are respectively accommodated in cylinders provided in the main body block, and a state in which the head block is inclined, i.e., a rocking state is obtained by a difference in positions in the cylinders of the head support members at the both ends.

According to the electric shaver, a rockable range of the head block is secured by a gap between a portion that supports the head support member and an end of the head block in the main body block. Thus, in order to increase the rockable range of the head block, the width of the main body block needs to increase, and there is a problem in that it is difficult to increase the rockable range in the reality.

Hence, it is an object of the present invention to provide an electric shaver capable of increasing a movable range of the blade head while preventing a main body from increasing in size.

DISCLOSURE OF INVENTION

An electric shaver of the present invention is characterized in that a blade head which comes into contact with skin to cut hair is connected to a grip portion, and the blade head includes an outer blade formed with a large number of openings through which hair is introduced inside of the blade head, an inner blade which slides along an inner face of the outer blade, and a motor which reciprocates the inner blade. In the electric shaver a support arm is rockably supported on one end of the grip portion and projects from the end. Both ends of the blade head are supported by the support arm such that the blade head can rock around an axis extending along a reciprocating direction of the inner blade. An axial direction of the rocking motion of the support arm with respect to the grip portion is set in a direction intersecting with the reciprocating direction of the inner blade.

In the present invention, it is preferable that the support arm is supported on the grip portion in a state where a projecting amount of the support arm from the grip portion can be changed in accordance with an external force received by the blade head.

In the present invention, it is preferable that a width of the support arm in the reciprocating direction of the inner blade is increased from its base end toward its tip end.

In the present invention, it is preferable that the support arm comprises a combination of at least two arm divided bodies.

In the present invention, it is preferable that the blade head includes a plurality of elongated slide blade assemblies, which include the inner and outer blades and extend approximately in parallel to each other along the reciprocating direction of the inner blade, and a rocking axis center of the blade head with respect to the support arm is set to a position located outside of an end of a contact region of the blade head with the skin in a direction substantially perpendicular to an abutting direction of the blade head against the skin and in a direction substantially perpendicular to the reciprocating direction of the inner blade, with respect to a center of the contact region.

In the present invention, it is preferable that the support arm extends from a base end to a tip end in a direction being inclined to the side of the rocking axis center of the blade head with respect to the support arm, with respect to the abutting direction of the blade head against the skin.

In the present invention, it is preferable that the slide blade assemblies are biased in the abutting direction by biasing mechanisms, respectively, and a biasing force by the biasing mechanism with respect to the slide blade assembly closer to the rocking axis center of the blade head with respect to the support arm is weaker than a biasing force by the biasing mechanism with respect to the slide blade assembly farther from the rocking axis center.

In the present invention, it is preferable that one of the blade head and the support arm includes a roller, and the other one includes an arc guide rail that rollingly guides the roller, and the roller is moved and guided along a track of the guide rail, thereby rocking the blade head with respect to the support arm.

In the present invention, it is preferable that the blade head is formed into an elongated shape along the reciprocating direction of the inner blade, and rocking load torque of the blade head with respect to the support arm is weaker than rocking load torque of the support arm and the blade head with respect to the grip portion.

BRIEF DESCRIPTION OF THE DRAWINGS

BEST MODE FOR CARRYING OUT THE INVENTION (First Embodiment) FIG. 1 are front and side views of an electric shaver according to the present embodiment, FIG. 2 is an exploded perspective view of the electric shaver, FIG. 3 is an exploded perspective view of a head portion of the electric shaver, FIG. 4 is an exploded perspective view of a support arm of the electric shaver, FIG. 5 are explanatory diagrams showing a variation of a support state of a blade head by the support arm, FIG. 6 is a front sectional view showing an internal structure of a connecting portion between the blade head and a grip portion, FIG. 7 is a side sectional view of the electric shaver, and FIG. 8 are explanatory diagrams showing a variation of a rocking state of the blade head.

In the following explanations, for the sake of convenience, FIG. 1(*a*) is defined as a front view, FIG. 1(*b*) is defined as a side view, the left side in FIG. 1(*b*) is defined as a front side and the right side in FIG. 1(*b*) is defined as a back side. Upper and lower sides are defined as shown in FIG. 1(*a*).

According to the electric shaver 1 of the present embodiment, a blade head 3 which shaves body hair such as beard is movably supported by one end of an elongated grip portion 2 to be grasped in its longitudinal direction, and skin-following capability of the blade head 3 is enhanced, thereby enhancing shaving performance.

Figure 1:
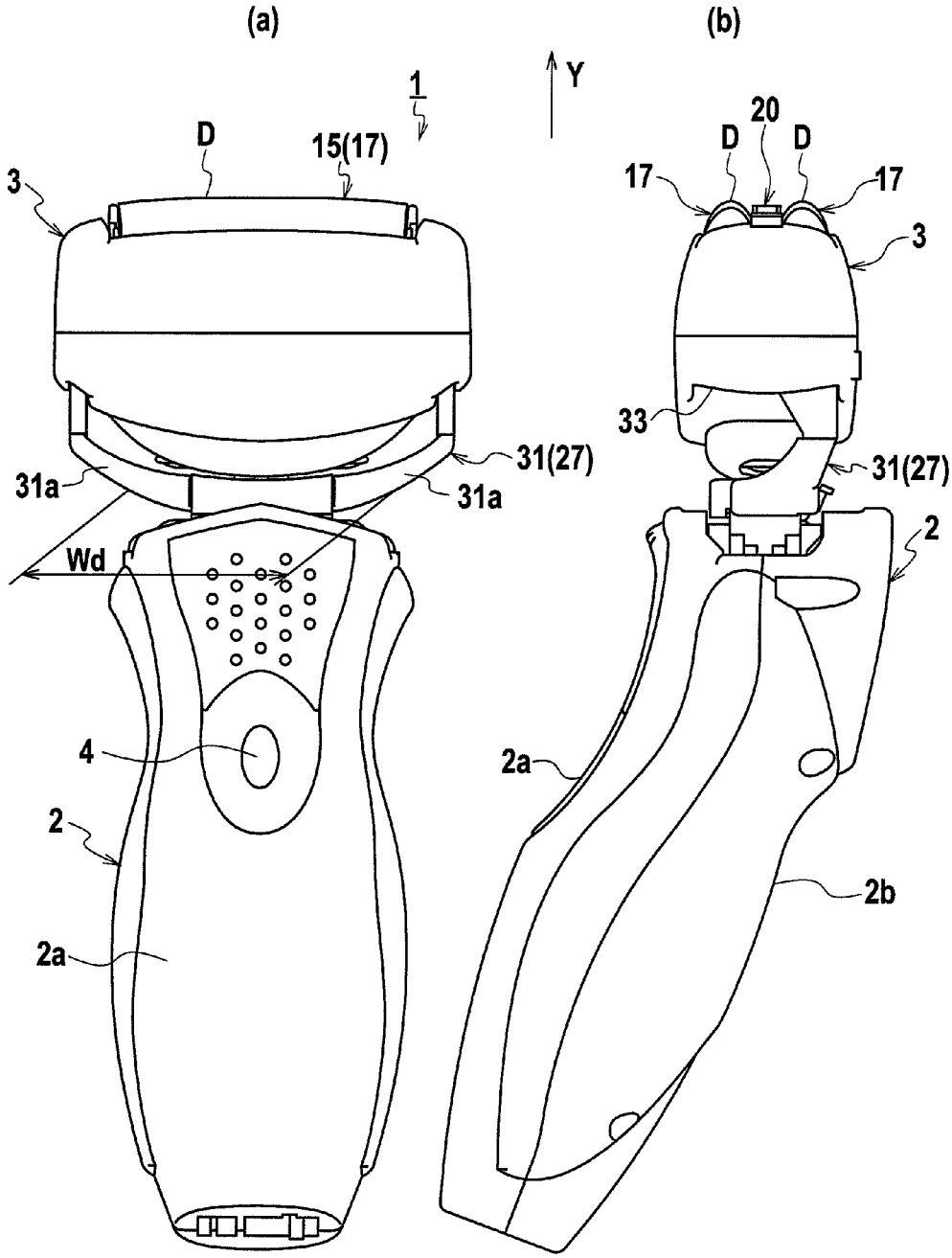
FIG. 1 is a front view (a) and a side view (b) of an electric shaver according to an embodiment of the present invention.

As shown in FIG. 1, the grip portion 2 is formed into a stick shape having a flat cross section. The grip portion 2 is appropriately provided with a narrowed portion and a swelled portion so that the grip portion 2 can easily be grasped by a hand and the fit is enhanced.

As shown in FIG. 1(*b*), the grip portion 2 is curved toward a front face 2*a* in lower positions at least on a portion that is closer to the blade head 3 or as a whole, so that blade faces D of the blade head 3 can fit a side of a face such as a cheek or under a nose in a state where the grip portion 2 is obliquely grasped. With this shape, the attitude in which the front face 2*a* of the grip portion 2 is directed downward and the back face 2*b* is directed upward makes the grip portion 2 to be grasped easiest when a side of a face such as a cheek is to be shaved. Therefore, the electric shaver 1 of the present embodiment is constituted such that the shaving performance is enhanced in this attitude.

As shown in FIG. 1(*a*), an operation button 4 is provided at a substantially central portion of the front face 2*a* of the grip portion 2 so that motion of movable blades provided in the blade head 3 can be controlled by an operation of the operation button 4.

Figure 2:
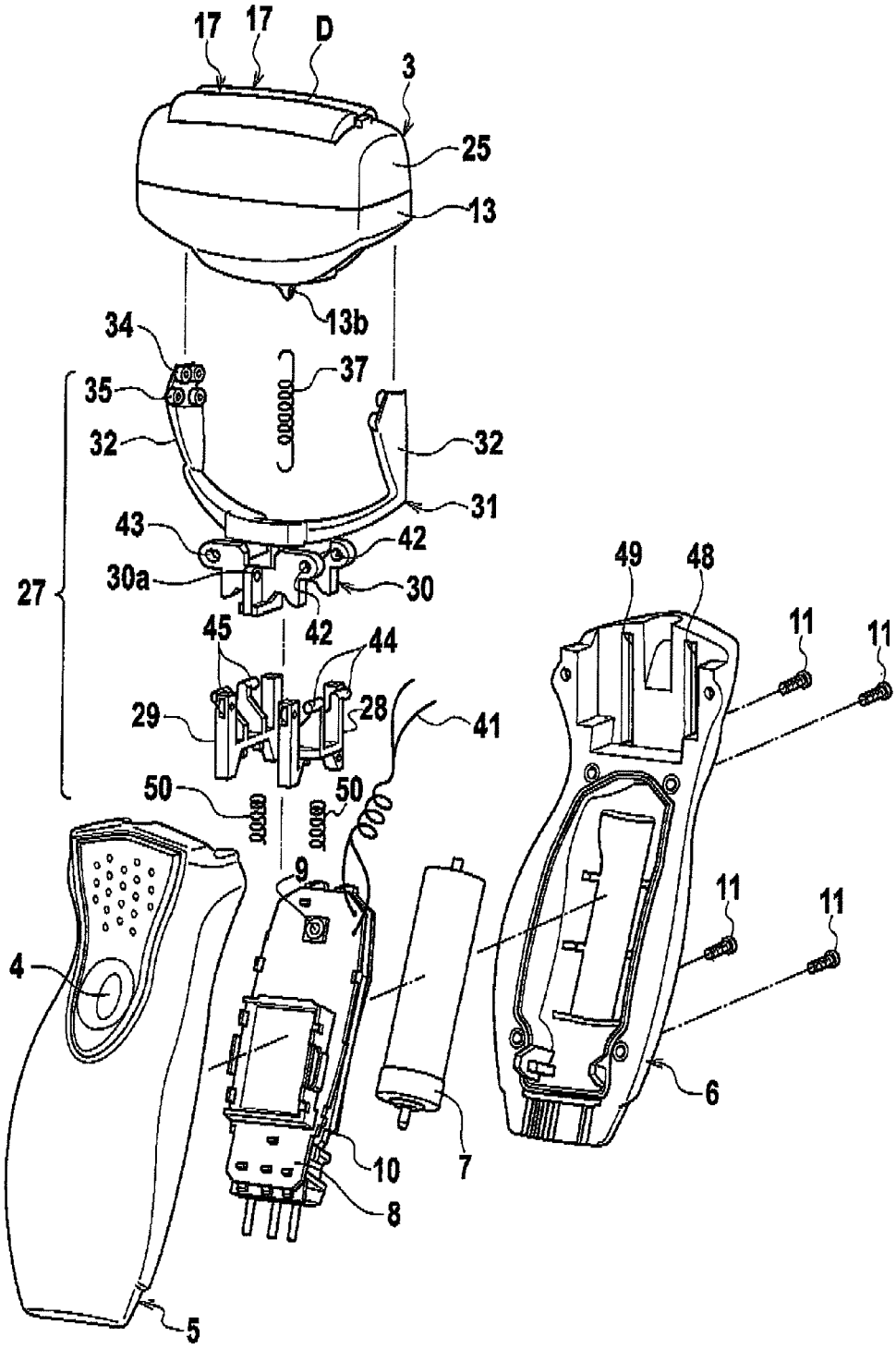
FIG. 2 is an exploded perspective view of the electric shaver of the embodiment of the invention.

As shown in FIG. 2, the grip portion 2 includes a front case 5 and a back case 6 coupled to each other through screws 11. A battery 7, a drive circuit 8, a switch 9, a base 10 that fixes these elements, and the like are accommodated in the cases.

Figure 3:
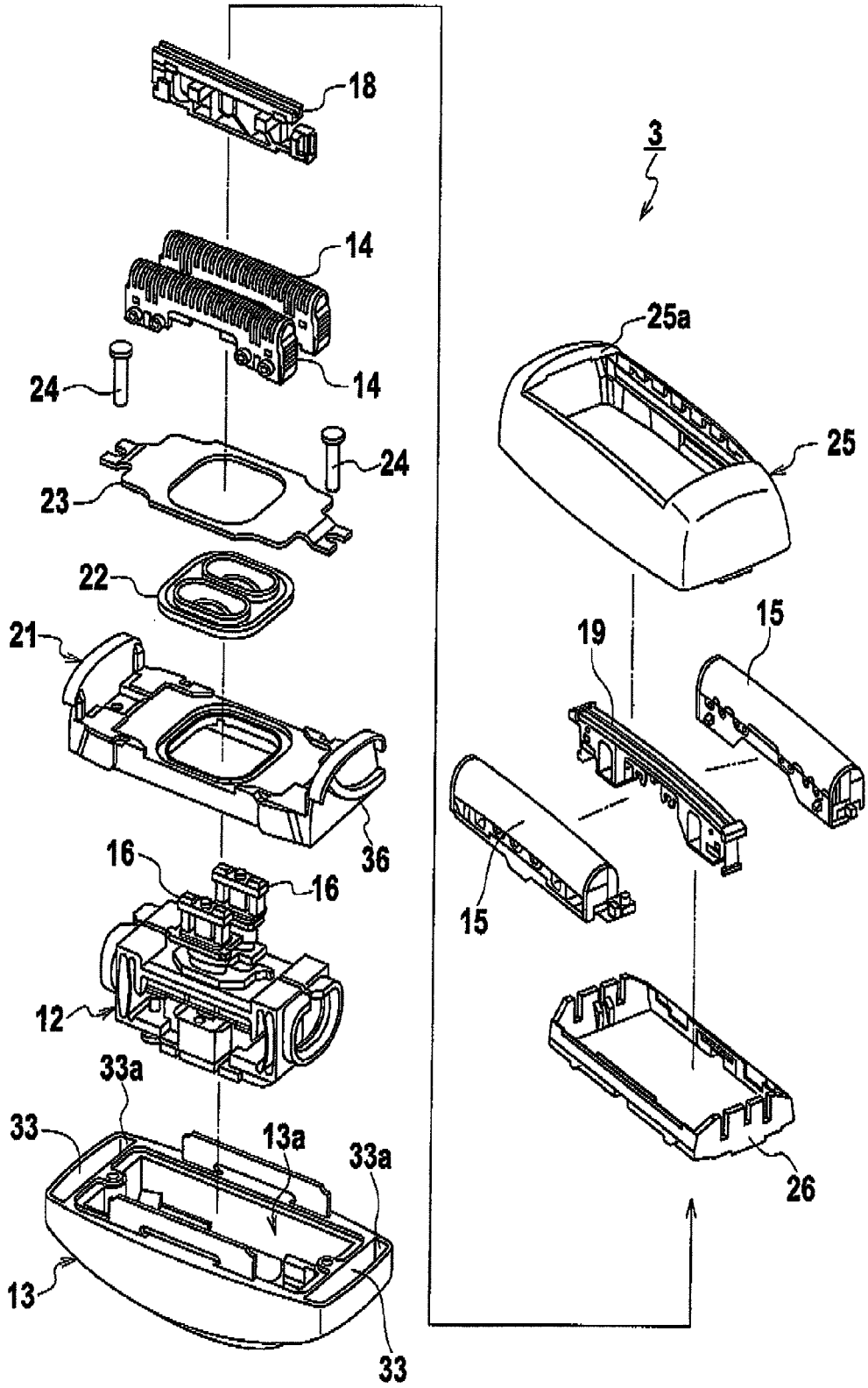
FIG. 3 is an exploded perspective view of a head portion of the electric shaver of the embodiment of the invention.

As shown in FIG. 3, the blade head 3 includes a reciprocating drive portion 12 in which a motor such as a linear motor is accommodated. The blade head 3 also includes a head case 13 in which the reciprocating drive portion 12 is accommodated. The blade head 3 also includes inner blades 14 and 18, and outer blades 15 and 19.

Reciprocating motion output (reciprocating vibration) caused by the reciprocating drive portion 12 is transmitted to the inner blades 14 through a drive element 16. The outer blades 15 are provided with a large number of openings (not shown), and the inner blades 14 reciprocate while slidingly contacting inner faces of the outer blades 15. Hair introduced toward the inner face of the outer blades 15 from the openings are cut by the sliding motion of the inner blades 14 and the outer blades 15. The inner blades 14 and the outer blades 15 are formed into elongated shapes, and the inner blades 14 reciprocate (vibrate) in the longitudinal direction. In the present embodiment, two net blade assemblies (slide blade assemblies) 17 comprising the inner blades 14 and the outer blades 15 are arranged in parallel to each other on front and back sides. A slit blade assembly 20 (FIG. 1) comprising the elongated slit inner blade 18 and slit outer blade 19 is provided between the two net blade assemblies 17 (FIG. 1).

The reciprocating drive portion 12 is inserted into an upper opening 13*a* of the head case 13. A head case cover 21, a drive element dustproof rubber 22 and a rubber pressure plate 23 are put thereon and they are fixed by screws 24.

The outer blades 15 and 19 are held by a holding frame 26 in a state where they are exposed from an opening 25*a* of a cover frame 25 movably upward and downward, i.e., in a state where a projecting amount thereof from the opening 25*a* can be changed. Two top curved faces of the outer blades 15 become blade faces D of the blade head 3 (see FIGS. 1 and 2).

Both ends of the blade head 3 are rockably supported by a substantially U-shaped support arm 27.

Figure 4:
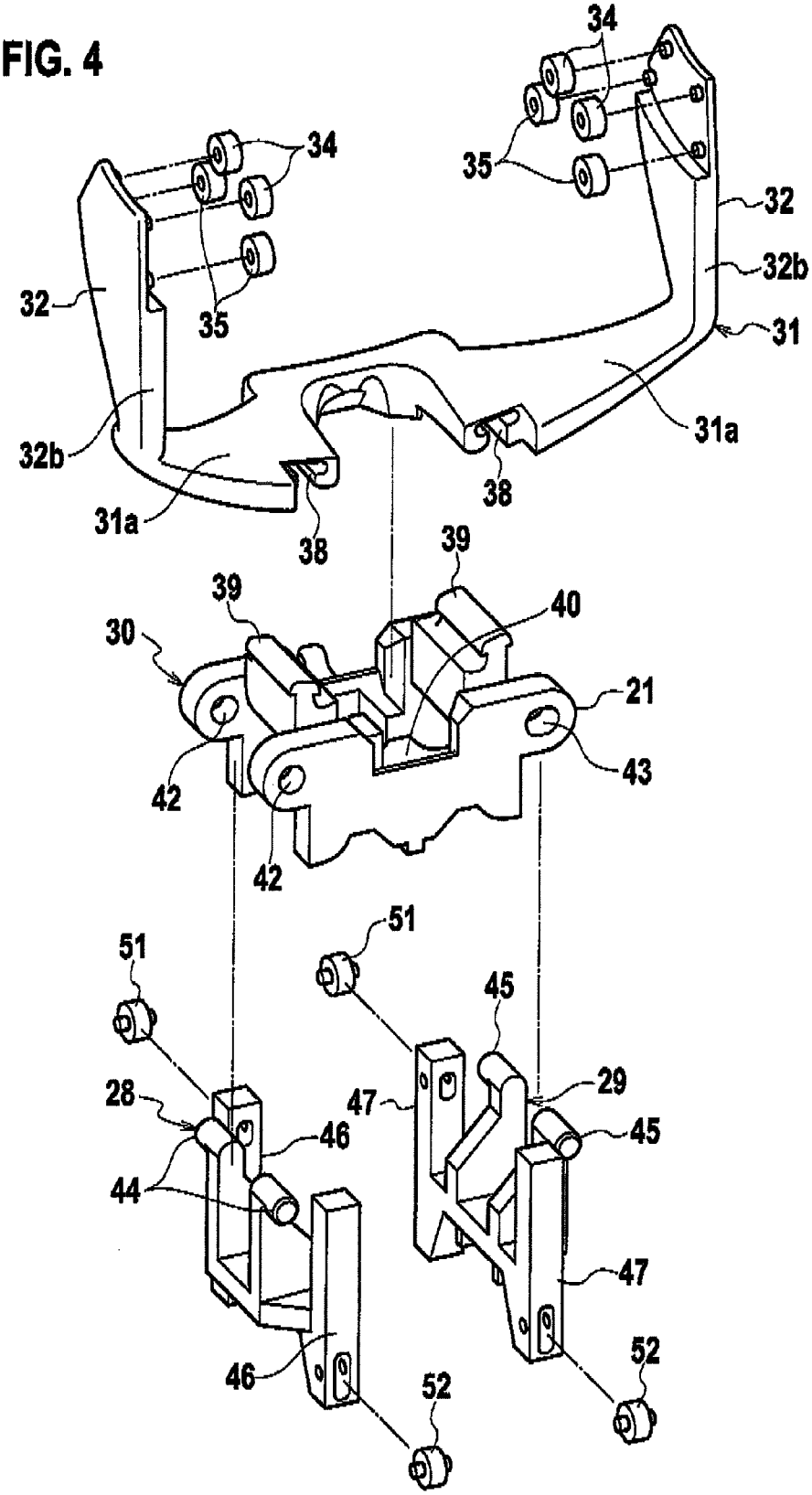
FIG. 4 an exploded perspective view of a support arm of the electric shaver of a first embodiment of the invention.

The support arm 27 is rockably supported on the side of one end of the grip portion 2. As shown in FIGS. 2 and 4, the support arm 27 basically includes float guides 28 and 29, a pedestal 30 and an arm portion 31.

As shown in FIG. 1 also, a width Wd of the inner blades 14 of (an inclined portion 31*a* of) the arm portion 31 in the reciprocating direction is gradually increased from a base end, i.e., a rocking support point side of the support arm 27 by the grip portion 2 toward a tip end, i.e., a rocking support point side of the blade head 3 by the support arm 27 so that interference between the support arm 27 that rocks crosswise and an upper end of the grip portion 2 is suppressed and a relatively wide rocking angle of the blade head 3 and the support arm 27 with respect to the grip portion 2 can be secured.

Erecting pieces 32 and 32 project from left and right sides of the arm portion 31, and the arm portion 31 has a substantially U-shape with the upper side being opened. Both ends of the blade head 3 in the longitudinal direction are supported (both ends-supported) by the pair of erecting pieces 32 and 32.

That is, rollers 34 and 35 are rotatably supported inside (inside of U-shape) of tip ends of the erecting pieces 32 and 32, and the erecting pieces 32 and 32 are respectively inserted into the blade head 3 from openings 33 and 33 formed in both ends of the blade head 3 in the longitudinal direction. Arc guide rails 36 are formed on side faces of the head case 13 of the blade head 3. The rollers 34 and 35 roll while slidingly contacting the guide rails 36 in a state where the guide rails 36 are sandwiched between the rollers 34 and 35 of the erecting pieces 32 and 32 inserted in the blade head 3, and thus a state where both ends of the blade head 3 are rockably supported by the arm portion 31 (support arm 27) is established. An axial direction of the rocking axis center O extends along the reciprocating direction of the inner blades 14.

According to this structure, the rocking axis center O of the blade head 3 with respect to the support arm 27 is determined as a center of an arc shape of the guide rail 36. That is, according to the present embodiment, since the combination of the rollers 34 and 35 and the guide rails 36 constitutes the rocking support mechanism, constraints on shapes and arrangement of the blade head 3 and the support arm 27 are small, and the rocking axis center O can be set an a more appropriate position.

Figure 5:
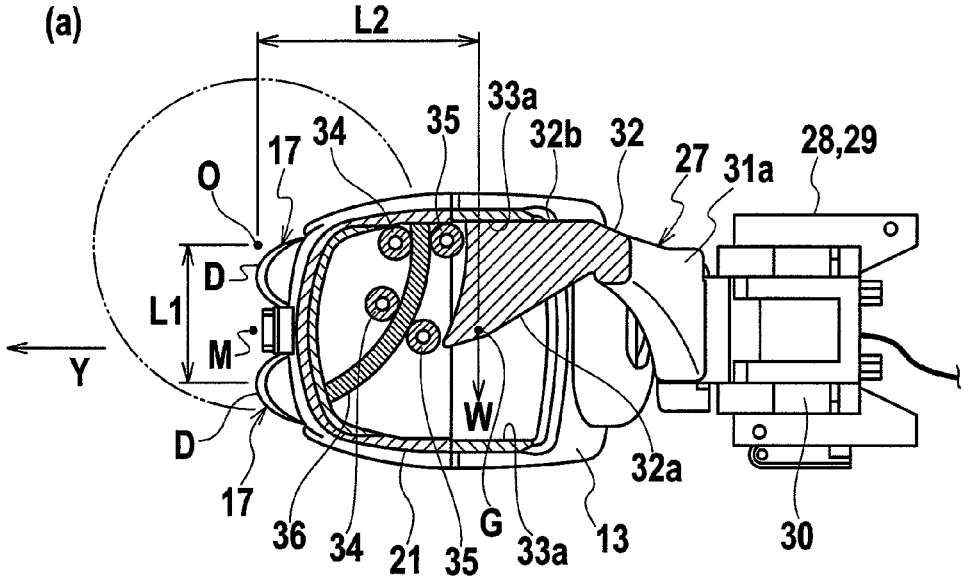
FIG. 5 is an explanatory diagrams showing a variation of a support state of a blade head by the support arm of the electric shaver of the embodiment of the invention.
Figure 5:
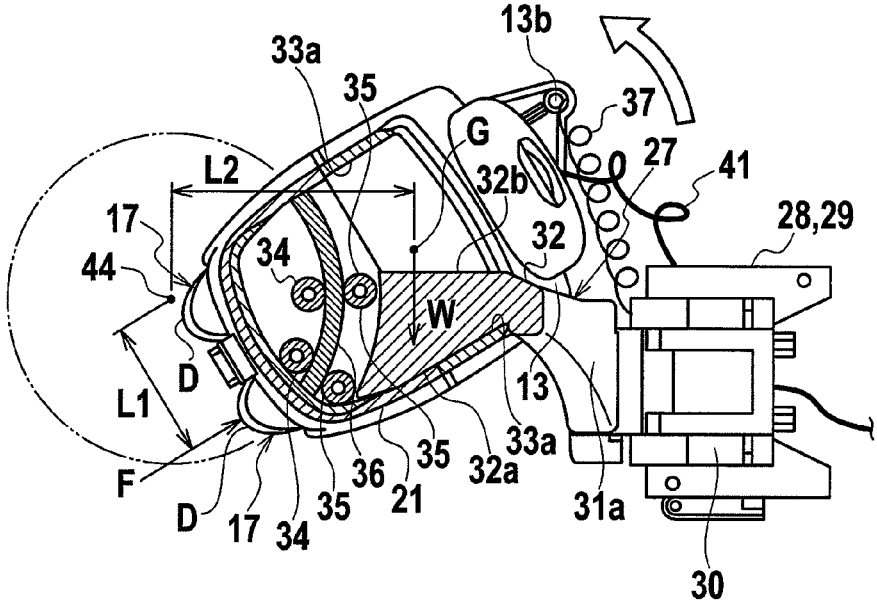

In the present embodiment, as shown in FIG. 5, the rocking axis center O is set to a position located outside (i.e., upper side in FIG. 5) of an end of a contact region (i.e., upper blade face D in FIG. 5; top of the outer blades 15) in a direction substantially perpendicular to an abutting direction of the blade head 3 against skin (direction of an arrow Y in FIG. 5; a projecting direction of the slide blade assemblies 17; a direction of the normal to a phantom plane including the blade faces D (substantially contact face with skin); upward in FIG. 1), and in a direction extending along the reciprocating direction of the inner blade (upward in FIG. 5), with respect to the contact center M of the blade head 3 with the skin, instead of the contact center (center of the contact region) M of the blade faces D of the blade head 3.

With the curved shape of the grip portion 2 and the positioning of the slide blade assemblies 17 in the blade head 3, when a side of a face is to be shaved, the electric shaver 1 of the present embodiment easily comes into contact with skin in an attitude where the front face is directed downward and the back face is directed upward. Generally, since a direction of hair on the side of the face is downward, it is preferable to move the electric shaver 1 upward in this attitude in the term of shaving performance.

When the front face of the electric shaver 1 is directed downward and the back face thereof is directed upward as shown in FIG. 5, the weight W of the blade head 3 is applied downward to the gravity enter G of the blade head 3. The weight W generates a rotation moment (magnitude: W×L2) in the clockwise direction in FIG. 5 around the rocking axis center O of the blade head 3 with respect to the support arm 27.

In the electric shaver 1, as shown in FIGS. 2, 5(*b*), and 7, a spring 37 as a tension spring is provided between a lock hole 13*b* of a lower portion of the blade head 3 and a lock hole 30*a* of the support arm 27 (e.g., pedestal 30) so that the blade head 3 returns to its initial position (attitude). Therefore, a rotation moment in a direction of rocking a lower portion of the blade head 3 forward (rotation moment in the clockwise direction in FIG. 5) is applied around the rocking axis center O to the blade head 3 by the biasing force of the spring 37.

Therefore, according to the present embodiment, the blade head 3 does not rock in the counterclockwise direction easily unless a rotation moment (F×L1) in the counterclockwise direction by a drag F applied by skin to the blade faces D becomes sufficiently greater than a rotation moment in the clockwise direction by the weight W and the biasing force of the spring 37, and the following capability to skin is deteriorated.

Hence, in the present embodiment, the rocking axis center O of the blade head 3 with respect to the support arm 27 is set to the position outside (i.e., upper side in FIGS. 5) of an end of the contact region in a direction substantially perpendicular to the abutting direction Y of the blade head 3 against skin and in a direction substantially perpendicular to the reciprocating direction of the inner blade (i.e., upper blade face D in FIGS. 5; top of the outer blades 15), with respect to the contact center M of the blade head 3 with the skin, instead of the contact center M of the blade faces D of the blade head 3. With this structure, a direction of the rocking of the blade head produced by a drag applied by the skin to the slide blade assembly 17 (rocking direction around the rocking axis center O) is set in the same direction (counterclockwise direction in FIGS. 5) for the plurality of slide blade assemblies 17, and a moment arm L1 of the rotation moment in the counterclockwise direction in FIGS. 5 generated by the drag F from the skin is increased. Thus, the rotation moment generated by a reaction force F is increased, and the following capability to the skin is enhanced.

When the grip portion 2 or a portion of the shaver from the grip portion 2 to the blade head 3 is curved such that the front face 2*a* of the grip portion 2 comes inward as in the present embodiment, it will be understood that a deviation of the rocking axis center O toward the back face 2*b* of the grip portion 2 corresponds to a deviation of the rocking axis center O outside of the curve.

In the present embodiment, (the inclined portion 31*a* of) the arm portion 31 extends in a direction inclined toward the rocking axis center O of the blade head 3 with respect to the support arm 27 to an abutting direction of the blade head 3 from the rocking support point by the grip portion 2 (direction of the arrow Y in FIG. 5). Accordingly, a support portion of the blade head 3 by the arm portion 31 approaches the rocking axis center O, and the rotation moment applied to the support portion can be reduced. Therefore, the support portion of the blade head 3 by the arm portion 31, and the arm portion 31 can be reduced in size and weight.

The two slide blade assemblies 17 and 17 are biased upward (in the abutting direction Y to the skin) by springs 53 (FIG. 6) as biasing mechanisms provided in the blade head 3. In the present embodiment, a biasing force of the spring 53 with respect to the rear (upper in FIGS. 5) slide blade assembly 17 closer to the rocking axis center O of the blade head 3 with respect to the support arm 27 is set weaker than the biasing force of the spring 53 with respect to the front (lower in FIGS. 5) slide blade assembly 17 farther from the rocking axis center O. Because the rear (upper in FIG. 5) slide blade assembly 17 closer to the rocking axis center has a shorter moment arm as compared with the front slide blade assembly 17, the rear slide blade assembly 17 does not rock around the rocking axis center O unless a greater force is applied. Thus, the following capability to the skin is deteriorated. To compensate this, the biasing force on the rear slide blade assembly 17 is relatively reduced so that the following capability of the rear slide blade assembly 17 is enhanced.

A rockable range around the rocking axis center O of the blade head 3 is determined by an attitude when sidewalls 32*a* and 32*b* of the erecting pieces 32 and 32 and inner walls 33*a* of the openings 33 and 33 in the rocking circumferential direction of the openings 33 and 33 abut as the blade head 3 rocks. Therefore, the rocking range can be adjusted by appropriately adjusting the shapes of the erecting pieces 32 and 32. In the present embodiment, the sidewalls 32*b* on the rear sides of the erecting pieces 32 and 32 erect upward, while the front sidewall 32*a* is inclined upward toward the front face. Accordingly, the blade head 3 can rock in a range from the attitude where the blade head 3 substantially erect (FIG. 5(*a*)) to an attitude where a lower portion of the blade head 3 is directed rearward (FIG. 5(*b*)).

As shown in FIG. 4, engaging grooves 38 are provided in base end of the arm portion 31, and engaging ribs 39 are provided on upper end of the pedestal 30. The engaging ribs 39 are slid and fitted into the engaging grooves 38, thereby fixing the arm portion 31 to the pedestal 30. In the present embodiment, the pedestal 30 and the arm portion 31 are separate members, but they may be integrally formed.

Figure 6:
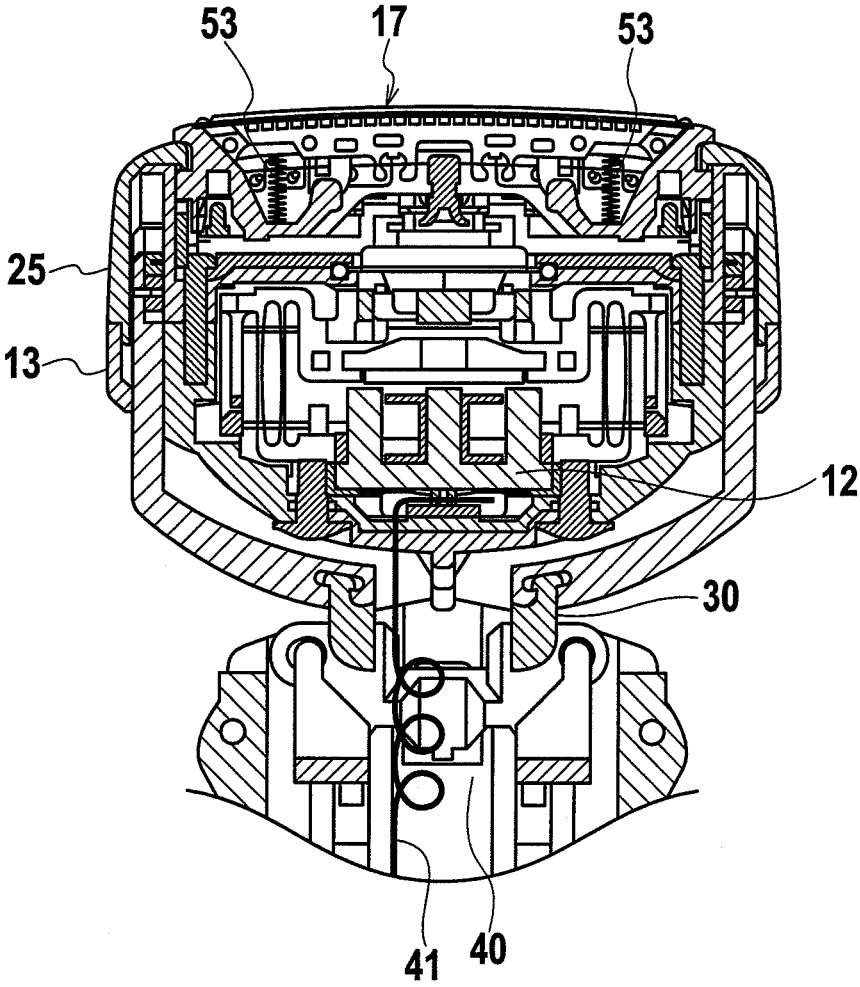
FIG. 6 is a front sectional view showing an internal structure of a connecting portion between the blade head and a grip portion of the electric shaver according to the first embodiment of the invention.

The pedestal 30 is formed into a frame shape having the opening 40. As shown in FIG. 6 also, a lead wire 41 vertically penetrates the opening 40. A motor in the reciprocating drive portion 12 and the drive circuit 8 are electrically connected through the lead wire 41. The lead wire 41 is spirally wound so that elasticity is secured.

Circular holes 42 are formed in front and rear portions on the left side of the pedestal 30. Elongated holes 43 are formed in front and rear portions on the right side of the pedestal 30. Front and rear two shafts 44 and 45 project from the float guides 28 and 29, respectively. The shafts 44 and 45 engage with the circular holes 42 and elongated holes 43.

Figure 7:
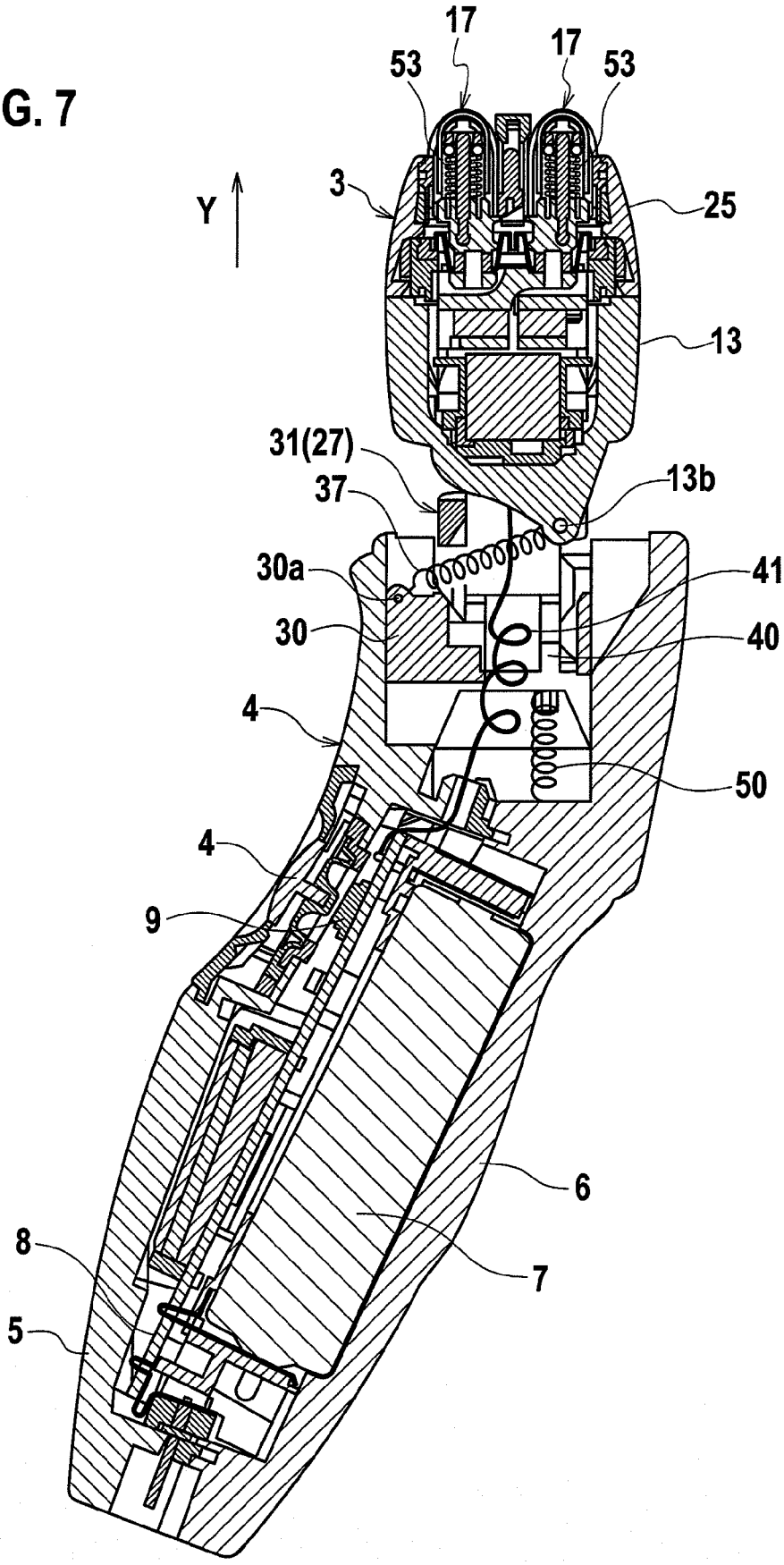
FIG. 7 is a side sectional view of the electric shaver of the embodiment of the invention.

Further, guide ribs 46 and 47 are provided on both of front and rear ends of the float guides 28 and 29, respectively. The guide ribs 46 and 47 are loosely inserted into guide grooves 48 and 49 (see FIG. 2) formed in the front case 5 and the back case 6 of the grip portion 2, and the guide ribs 46 and 47 are vertically slidably guided. The float guides 28 and 29 are biased by springs 50 and 50 (see FIGS. 7 and 8) as biasing means in the abutting direction (upward) Y. Rollers 51 and 52 are provided on upper portions of front sides of the float guides 28 and 29 and lower portions of rear sides thereof, respectively. Sliding resistances between the float guides 28 and 29 and the guide grooves 48 and 49 are reduced by these rollers 51 and 52.

According to a lower structure of the support arm 27 including the float guides 28 and 29, the pedestal 30 and the springs 50 and 50, the extended and compressed states of the springs 50 and 50 are changed depending upon the magnitude of a load applied to the blade head 3 from above. More specifically, as the load applied to the blade head 3 is greater, the blade head 3 and the support arm 27 are located at lower positions relative to the grip portion 2, and as the load applied to the blade head 3 is smaller, the blade head 3 and the support arm 27 are located at upper positions relative to the grip portion 2. That is, with this structure according to the present embodiment, a state in which the support arm 27 is supported in a state in which a projecting amount of the support arm 27 from the grip portion 2 can be changed in accordance with an external force received by the blade head 3 is embodied.

Figure 8:
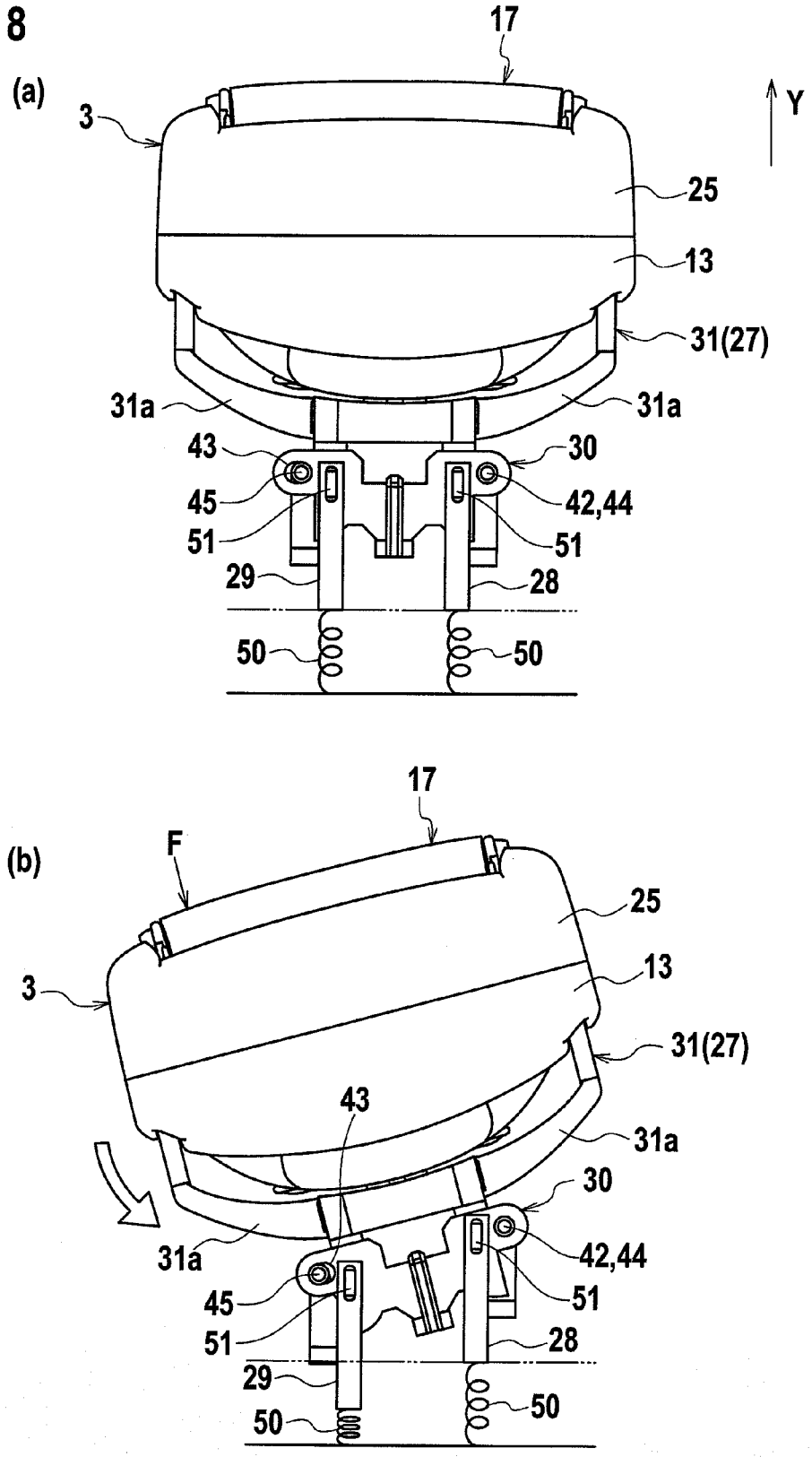
FIG. 8 is an explanatory diagrams showing a variation of a rocking state of the blade head of the electric shaver of the embodiment of the invention.

As shown in FIG. 8(*b*), when an eccentric load F is applied to the blade head 3 from above, upper and lower positions of the float guides 28 and 29 are different from each other, and the blade head 3 rocks around the shaft 44. FIG. 8 only show a state where the blade head 3 rocks in the counterclockwise direction, but it will easily be understood that the positional relation between the float guides 28 and 29 can be opposite in the crosswise direction and the blade head 3 can rock in the opposite direction. That is, in the present embodiment, this structure enables the support arm 27 to rock with respect to the grip portion 2. An axial direction of the rocking motion at that time is a direction intersecting with the reciprocating direction of the inner blades 14 (a direction substantially orthogonal direction to the reciprocating direction of the inner blades 14 in the case of the present embodiment).

In the present embodiment, the blade head 3 is elongated. Therefore, a rotation moment which rocks the blade head 3 in the crosswise direction as viewed from the front face 2*a* (rotation moment which produces the state shown in FIG. 8(*b*)) becomes greater than a rotation moment which rocks the blade head 3 in the front-back direction (rotation moment which produces the state shown in FIG. 5(*b*)) with respect to inputs having the same magnitudes (reaction force from skin) due to a relation of a distance from an axis center to a point of application of force (moment arm). Therefore, when the rocking load torque is the same in the front-back direction and the crosswise direction, the blade head 3 can not easily rock in the front-back direction as compared with the crosswise direction. As a result, following capability when the blade head 3 rocks in the front-back direction becomes worse than following capability when the blade head 3 rocks in the crosswise direction.

Hence, in the present embodiment, biasing forces of the springs 50 and 50 as the biasing means, the setting positions thereof, a biasing force of the spring 37 as another biasing means, and the setting position thereof are adjusted appropriately, thereby bringing rocking load torque of the blade head 3 with respect to the support arm 27 around the rocking axis center O lower than rocking load torque of the blade head 3 and the support arm 27 with respect to the grip portion 2 around the rocking axis center O, to reduce a difference in moment aims between the front-back direction and the crosswise direction. Accordingly, the rocking load of the blade head 3 with respect to the support arm 27 and the rocking load of the blade head 3 and the support arm 27 with respect to the grip portion 2 become substantially equal to each other.

According to the present embodiment, the support arm 27 which rockably supports the blade head 3 is rockably supported by the grip portion 2 in a state where the support arm 27 is projected from one end of the grip portion 2. Therefore, as compared with the conventional structure, the rockable range of the support arm 27 can be enlarged, and the following capability to the skin can be enhanced, thereby enhancing the shaving performance.

According to the present embodiment, since the support arm 27 is supported in a state where the projecting amount of the support arm 27 from the grip portion 2 can be changed in accordance with the external force received by the blade head 3, impact on skin can be moderated by the supporting structure of the support arm 27 by the grip portion 2.

According to the present embodiment, the width (width of the inner blades 14 in the reciprocating direction) Wd of the support arm 27 is gradually increased from the base end toward the tip end, i.e., from the rocking support point side by the grip portion 2 toward the rocking support point side of the blade head. Therefore, a range in which the support arm 27 rocks and abuts against the sidewall of the grip portion 2 can be enlarged, and the rockable ranges of the support arm 27 and the blade head 3 can be enlarged correspondingly.

According to the present embodiment, the rocking axis center O of the blade head 3 with respect to the support arm 27 is deviated to a position outside of the end (blade faces D) of the contact region in a direction substantially perpendicular to the abutting direction Y of the blade head 3 against skin and in a direction substantially perpendicular to the reciprocating direction of the inner blade, with respect to the contact center M. Therefore, when the blade head 3 which abuts against skin is moved in a direction perpendicular to the reciprocating direction of the inner blades 14, the skin-following capability of the blade head 3 can be enhanced on the side separated from the rocking axis center O while rocking directions (rocking directions around the rocking axis center) of the blade head by a drag applied to the slide blade assembly from the skin are the same for the plurality of slide blade assemblies. Thus, the shaving performance can be enhanced.

In this case, when the blade head 3, i.e., the electric shaver 1 is pressed against skin and when it is moved in a direction in which an end edge of the blade head 3 closer to the rocking axis center O is front and an end edge of the blade head 3 far from the rocking axis center O is rear, the pressing force of the blade head 3 against skin becomes higher on the side closer to the rocking axis center O (rear slide blade assembly 17). Thus, pulling and expanding effect of skin is enhanced, and the shaving performance can be further enhanced.

Therefore, when the grip portion 2 (portion from the grip portion 2 to the blade head 3) is curved or bent along a face perpendicular to the longitudinal direction (reciprocating direction of the inner blades 14) of the blade head 3 as shown in FIG. 1, and when the grasping attitude, a direction of hair on a side of a face (downward) and a direction of motion suitable for the direction of the hair (upward direction) are taken into account, it is effective that the rocking axis center O is deviated outward of the curve or bending.

According to the present embodiment, the support arm 27 is extended in a direction inclining toward the rocking axis center O with respect to the support arm 27 of the blade head 3 to the abutting direction Y of the blade head 3 to the skin from the base end toward the tip end. Thus, a support point of the blade head 3 by the support arm 27 is brought closer to the rocking axis center O, and a moment applied to the support point can be reduced. Therefore, a support portion of the blade head 3 by the support arm 27, and the support arm 27 can be made smaller in size.

According to the present embodiment, the blade head 3 includes the plural elongated slide blade assemblies 17 which extend mutually approximately in parallel along the reciprocating direction of the inner blades 14, and a biasing force by the spring 53 as the biasing mechanism with respect to the slide blade assembly 17 closer to the rocking axis center O with respect to the support arm 27 of the blade head 3 is weaker than a biasing force by the spring 53 as the biasing mechanism with respect to the slide blade assembly 17 farther from the rocking axis center O. Therefore, the skin-following capability of the slide blade assembly 17 closer to the rocking axis center O can be enhanced, thereby enhancing the shaving performance.

According to the present embodiment, the rollers 34 and 35 and the guide rails 36 are used. Thus, the deviation amount of the rocking axis center O can be increased, thereby further enhancing the shaving performance.

According to the present embodiment, the blade head 3 is formed into an elongated shape along the reciprocating direction of the inner blades 14, and rocking load torque of the blade head 3 with respect to the support arm 27 is lower than rocking load torque of the blade head 3 and the support arm 27 with respect to the grip portion 2. Therefore, the rocking load of the blade head 3 and the support arm 27 with respect to the grip portion 2 and the rocking load of the blade head 3 with respect to the support arm 27 can be made closer to each other, and even if the electric shaver is moved in any direction along the skin, the skin-following capability can be enhanced.

Figure 9:
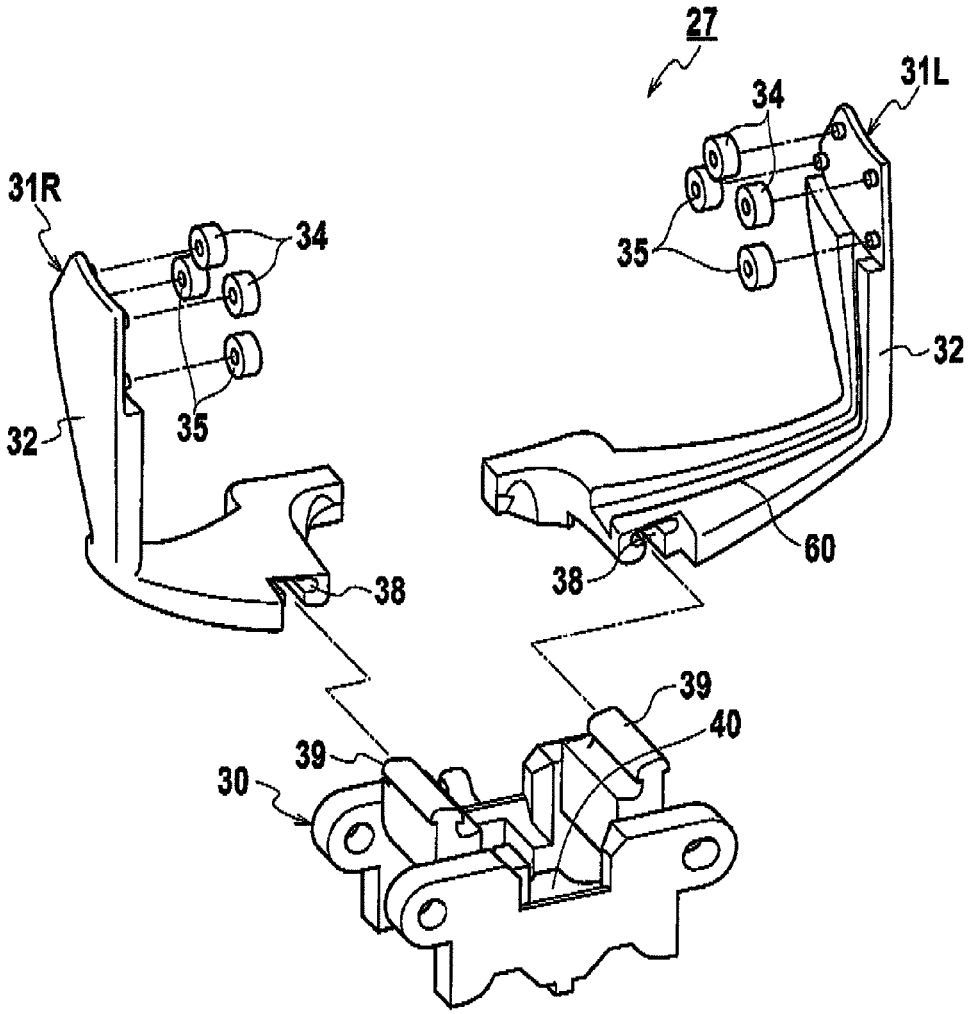
FIG. 9 is an exploded perspective view of relevant parts of a support arm of an electric shaver according to a second embodiment of the invention.
Figure 10:
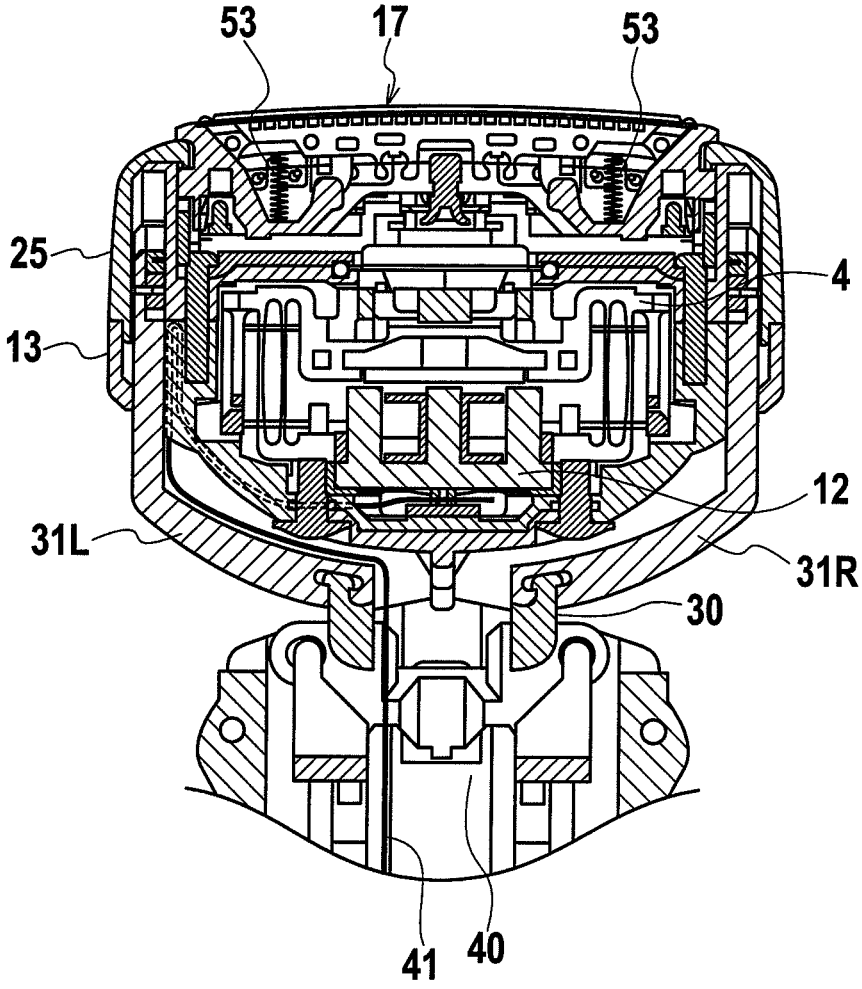
FIG. 10 is a front sectional view showing an internal structure of a connecting portion between a blade head and a grip portion of the electric shaver according to the second embodiment of the invention.

(Second Embodiment) FIG. 9 is an exploded perspective view of relevant parts of the support arm according to the present embodiment. FIG. 10 is a vertical sectional view of a connection between the blade head and the grip portion. The electric shaver according to the present embodiment has the same constituent elements as those of the electric shaver of the first embodiment. Therefore, the same constituent elements are designated with the same reference numerals, and redundant explanation will be omitted.

In the present embodiment, at least two arm divided bodies 31L and 31R are combined to constitute the arm portion 31 of the support arm 27.

According to the present embodiment, the freedom degree in a procedure for assembling the elements is enhanced, and it is possible to easier and more quickly assemble the support arm 27, engage the guide rollers 34 and 35 and the guide rails 36 with each other, and therefore assemble the electric shaver 1.

The structure and other constituent elements of the support arm 27 in a state where the arm divided bodies 31L and 31R are assembled are the same as those of the first embodiment. Therefore, of course, the same effects as those of the first embodiment can be obtained.

In the present embodiment, a groove 60 is formed from a base end to a tip end of an inner face of the arm divided body 31L, and the lead wire 41 is arranged in the groove 60. The lead wire 41 extends to a portion close to the rocking support point, and is inserted into a hole (not shown) formed in the blade head 3 (e.g., head case 13).

Therefore, according to the present embodiment, the lead wire 41 cannot easily be seen from outside, which adds to the beauty. Besides, it is possible to prevent the lead wire 41 from coming into contact with a movable portion such as the blade head 3, the rocking amount of the lead wire 41 is suppressed, and the reliability of the lead wire 41 and thus the electric shaver 1 is enhanced.

While the preferred embodiments of the present invention have been described, the present invention is not limited to these embodiments and various modifications can be made.

Industrial Applicability

According to the electric shaver of the present invention, the support arm which rockably supports the blade head is supported by a grip portion such that the support arm can rock in a state where the support arm projects from one end of the grip portion. Therefore, as compared with the conventional structure, the rockable range of the support arm can be increased, and the skin-following capability can be enhanced, thereby enhancing the shaving performance.

The invention claimed is:

1. An electric shaver in which a blade head which comes into contact with skin to cut hair is connected to a grip portion, and the blade head includes a plurality of slide blade assemblies each having an outer blade having a plurality of openings through which the hair is introduced inside of the blade head, and an inner blade which slides along an inner face of the outer blade, wherein a support arm is supported on one end of the grip portion to make a first rocking motion and projects from the one end in a state where a projecting amount of the support arm from the grip portion varies in accordance with an external force received by the blade head, both ends of the blade head are supported by the support arm such that the blade head assembly makes a second rocking motion around an axis extending along a reciprocating direction of the inner blade, below a support portion of the blade head, the support arm is rockably supported by first and second float guides, and the support arm is connected to the grip portion via the first and second float guides, and the support arm makes the first rocking motion relative to the first and second float guides, the first float guide is provided with a first shaft which connects the first float guide and the support arm, the second float guide is provided with a second shaft which connects the second float guide and the support arm, the first rocking motion is achieved by one of the first shaft and the second shaft configured not to make a positional change with respect to the support arm, and the first shaft and the second shaft configured to make a positional change with respect to the grip portion, the first and second shafts are configured to make relative motion with each other, each of the first and second float guides is connected to the grip portion to make a positional change with respect to the grip portion, an axial direction of the first rocking motion of the support arm with respect to the grip portion is set in a direction intersecting with the reciprocating direction of the inner blade, and in accordance with the positional change of each of the first and second float guides with respect to the grip portion, a position of a rotational center of the first rocking motion of the support arm with respect to the grip portion changes.

2. The electric shaver according to claim 1, wherein the support arm includes:

a pedestal which is supported on the first and second float guides in such a state that the pedestal can rock and whose projecting amount is changeable, and a base and an arm portion, wherein the an arm portion supports the blade head, and wherein the base is fixed to the pedestal.

3. The electric shaver according to claim 2, wherein the arm portion comprises a combination of two arm divided bodies.

4. The electric shaver according to claim 3, wherein the two arm divided bodies include a pair of a right arm divided body and a left arm divided body which respectively support a right end and a left end of the both ends of the blade head.

5. The electric shaver according to claim 2, wherein a width of the base is decreased from its base end where the base is connected to the pedestal toward its tip ends.

6. The electric shaver according to claim 5, wherein a width of the arm portion is decreased from where the arm portion supports the both ends of the blade head to where the support arm portion meets the tip ends of the base.

7. The electric shaver according to claim 2, wherein the pedestal has rotational shaft receiving portions for receiving the first and second shafts of the first and second float guides.

8. The electric shaver according to claim 7, wherein the pedestal has four rotational shaft receiving portions.

9. The electric shaver according to claim 1, wherein the support arm supports the blade head such that a rocking axis center of the blade head with respect to the support arm is set to a position located outside of an end of a contact region of the blade head with the skin in a direction substantially perpendicular to an abutting direction of the blade head against the skin and in a direction substantially parallel to the reciprocating direction of the inner blade.

10. The electric shaver according to claim 9, wherein the support arm has a U-shape.

11. The electric shaver according to claim 9, wherein the slide blade assemblies are biased in the abutting direction by biasing mechanisms, and a biasing force by the biasing mechanism with respect to the slide blade assembly closer to the rocking axis center of the blade head is weaker than a biasing force by the biasing mechanism with respect to the slide blade assembly farther from the rocking axis center of the blade head.

12. The electric shaver according to claim 9, wherein the support arm includes rollers and arc guide rails that rollingly guide the rollers, and the rollers are moved and guided along tracks of the guide rails, thereby rocking the blade head with respect to the support arm.

13. The electric shaver according to claim 1, wherein the blade head has an elongated shape along the reciprocating direction of the inner blade, and a rocking load torque of the blade head with respect to the support arm is weaker than a rocking load torque of the support arm and the blade head with respect to the grip portion.

14. The electric shaver according to claim 1, wherein the first shaft extends from and is integral with the first float guide, and the second shaft extends from and is integral with the second float guide.

* * * * *